United States Patent [19]

Bjork

[11] Patent Number: 4,985,392

[45] Date of Patent: Jan. 15, 1991

[54] COLORED THERMOGRAPHIC MEDIA

[75] Inventor: Jon A. Bjork, Cottage Grove, Minn.

[73] Assignee: Minnesota Mining and Manufacturing Company, St. Paul, Minn.

[21] Appl. No.: 342,105

[22] Filed: Apr. 21, 1989

[51] Int. Cl.[5] ..... B41M 5/18

[52] U.S. Cl. ..... 503/211; 427/150; 427/151; 428/913; 503/214; 503/216; 503/217; 503/225

[58] Field of Search ..... 106/21; 427/150–152; 428/913; 503/211, 214, 216, 217, 225

[56] References Cited

U.S. PATENT DOCUMENTS

| | | | |
|---|---|---|---|
| 4,020,056 | 4/1977 | Farber | 260/240 D |
| 4,107,428 | 8/1978 | Farber | 542/437 |
| 4,531,141 | 7/1985 | Sagawa | 346/209 |
| 4,658,276 | 4/1987 | Kanda et al. | 346/220 |
| 4,704,379 | 11/1987 | Shioi et al. | 503/211 |
| 4,730,057 | 3/1988 | Kanda et al. | 548/524 |
| 4,748,148 | 5/1988 | Kondo et al. | 503/220 |
| 4,808,565 | 2/1989 | Whitcomb et al. | 503/211 |

FOREIGN PATENT DOCUMENTS

| | | |
|---|---|---|
| 0124377 | 7/1984 | European Pat. Off. . |
| 0242169 | 10/1987 | European Pat. Off. . |

*Primary Examiner*—Bruce H. Hess

*Attorney, Agent, or Firm*—Donald M. Sell; Walter N. Kirn; Mark A. Litman

[57] ABSTRACT

The present invention provides an intensely colored thermographic medium useful for bar-coding applications which utilize near infrared scanning systems. The medium is formed of a substrate having on at least one surface thereof a coating comprising: a transparent film-forming binder, an organic solvent soluble catechol, a metal salt and colorant.

20 Claims, No Drawings

COLORED THERMOGRAPHIC MEDIA

TECHNICAL FIELD

The present invention relates to thermographic imaging materials. More particularly it relates to intensely colored thermographic materials which, when imaged, provide light-stable images exhibiting exceptional contrast over the background media upon exposure to near infrared radiation.

BACKGROUND OF THE INVENTION

For many years heat-sensitive imaging materials have been used for copying, thermal printing, thermal recording and thermal labeling. Typically, thermal imaging with these materials involves thermally increasing the reactivity of two or more components of a color forming reaction which do not react at normal ambient temperatures. Reactivity is often enhanced by melting one or both reactants which are physically separated from one another. Generally, physical separation of the color forming components is accomplished by either situating them in separate coated layers or by dispersing them in a single coated layer.

In commercial thermal labeling or "bar-coding" applications, thermally developed labels are sought which have thermally generated, light-stable images, capable of being read or scanned by image scanning devices (scanners), disposed on intensely colored background media. In addition to the aesthetic appeal of such labels, they are highly desirable as a means for providing easy visual differentiation, on the basis of color, between labeled items. Such labels can be used to differentiate between labeled items with respect to a particular feature such as production date, product size, product line, make, model, etc., simply by associating said feature with a particular background color. Black is especially desirable where it is necessary to prevent visual detection of the image for security purposes.

The ability of a scanner to scan an image, or to discriminate between the image and the background, is measured by the "print contrast signal". The print contrast signal is measured and expressed as a function of the particular wavelength of radiation the imaged media is exposed to, and is defined as the quotient of the difference between the background reflectance and the image reflectance divided by the background reflectance, i.e. $[(R_{bkg}-R_{image})/R_{bkg}]$. The greater the print contrast signal the easier the imaged media can be scanned by a scanner. In this regard, the Uniform Product Code Council has issued performance standards for scanner scannable imaged media which establish the maximum allowable image reflectance for any given value of background reflectance according to the following algorithm:

$$\log_{10}R_{image}=2.6\ (\log_{10}R_{bkg})-0.3$$

Thus for any measured value of background reflectance, the maximum allowable image reflectance, and hence, the minimum allowable print contrast signal, can be determined. At print contrast signal values below the calculated minimum, the "first scan rate", a measure of the accuracy of correctly reading the image on the first scan, will be unacceptably low. At print contrast signal values above the calculated minimum, the scanner can quickly and accurately scan the image on the first scan.

Increasing the first scan rate of imaged media by a scanner may thus be accomplished by increasing the difference between the background reflectance and the image reflectance at the specific wavelength of radiation used in the scanner. To achieve high scanner first scan rates at any specific wavelength it is generally preferred that the imaged area absorb strongly (low reflectance) at that wavelength and the background absorb weakly (high reflectance) at that wavelength.

The most important wavelengths of radiation for bar-coding applications are determined by the scanning equipment commercially available. Scanners scanning in the visible region of the electromagnetic spectrum typically employ a helium-neon laser and read at 633 nm. Scanners scanning in the near infrared spectral region typically employ a gallium-arsenide laser diode and read at 905 nm. Recently, however, a new spectral source has become available for scanning in the near infrared region which enables an scanner to scan at 850 nm.

When an image is scanned by a scanner, it is essential that the background not interfere with the reading of the imaged areas. There must be clear and distinct contrast between the imaged and non-imaged areas for the scanner to be able to distinguish between the two. For this reason, thermographic labels intended to be scanned by scanners operating in the visible region of the electromagnetic spectrum typically have white or very lightly colored backgrounds. Lightly colored media, such as light pinks and yellows, have been used and found acceptable for scanning in the visible region at a wavelength of 633 nm, since these lightly colored materials absorb too weakly at that wavelength to interfere with the reading of the imaged areas. The use of intensely colored thermographic media in conjunction with scanners scanning in the visible region, on the other hand, has generally been proscribed, despite the above-mentioned desirability of such labels in the marketplace, because the background reflectance is generally too low to provide acceptable first scan rates.

For thermographic labels intended to be scanned in the near infrared spectral region, it is likewise essential that the image and the background differ sufficiently in their absorptance at the wavelength being used, to provide sufficient contrast for the scanner to distinguish between the two. It is generally preferred that the image absorb strongly in the near infrared and the background reflect strongly in the near infrared in order to provide such image discrimination.

An example of such a thermographic label has been commercially available from the Minnesota Mining and Manufacturing Company, since 1980, under the trade designation "Scotchmark" brand thermal label stocks. These labels provide a thermally generated image which absorbs strongly in both the visible and near infrared spectral regions by reacting an iron salt with a catechol to form a near infrared absorbing complex. The image is disposed on a background colored a light yellow by the dispersion of yellow pigment throughout the reactant containing layer of the label. However, despite the presence of the yellow pigment, these labels have sufficient contrast between the image and the background to meet the Uniform Product Code Council performance standards for scanning in both the visible and the near infrared spectral regions. There thus appears to be a presumption in the industry that the background should be lightly colored or white to avoid interfering with the image scannability even when scanning in the near infrared spectral region.

Contrary to this presumption, the inventor of the present invention has discovered that infrared scannable thermal labels can have intensely colored backgrounds while maintaining sufficient image discrimination to meet the Uniform Product Code Council performance standards for scanning in the near infrared spectral region. These labels provide the industry with the aesthetic appeal and color coding ability it desires. Furthermore, such intensely colored labels provide the industry with the ability to prevent visual discrimination of the image by increasing the intensity of the background color, where desirable for security reasons, without prohibiting scanning of the image with a scanner.

SUMMARY OF THE INVENTION

The present invention provides an intensely colored thermographic medium useful for thermal labeling or bar-coding applications which utilize near infrared scanning systems. The thermographic medium of the invention is capable of being intensely colored by the addition of dyes or organic pigments and still provide acceptable image discrimination upon exposure to near infrared radiation, even though it will no longer be readily scannable in the visible region, e.g., at a wavelength of 633 nm.

The intensely colored thermographic medium of the present invention comprises a substrate having on at least one surface thereof a coating comprising:

(a) a substantially transparent film-forming binder;
(b) an organic solvent soluble catechol, in solid solution in said binder;
(c) substantially insoluble microparticles of a metal salt dispersed throughout said binder; and
(d) at least one colorant dispersed throughout said binder in an amount sufficient to provide said thermographic medium with a maximum background reflectance of less than about 70% at any and all wavelengths within the range of from 400 nm to 700 nm; wherein said metal salt and said catechol are unreactive at room temperatures but react to form a near infrared absorbing complex upon the application of heat.

Surprisingly, the intensely colored thermographic medium provides all of the advantages and desired properties previously mentioned and yet has sufficient contrast to provide acceptable first scan rates when scanned in the near infrared spectral region, i.e., from about 750 nm to about 1000 nm.

As used herein, intensely colored is defined as having a maximum background reflectance of less than about 70% at any and all wavelengths within the range of from 400 nm to 700 nm, i.e., within the visible region of the spectrum.

DETAILED DESCRIPTION OF THE INVENTION

The metal salts useful in the present invention preferably comprise salts of aliphatic organic acids, and more preferably salts of carboxylic acids or phosphoric acids. Preferably, the alkyl portion of said acids contains between 8 and 24 carbon atoms, more preferably between 14 and 20 carbon atoms. Metals useful in the present invention include iron, vanadium, nickel and copper with iron being the preferred metal in the composition, and iron(III) being especially preferred as the iron(III)-catechol complex is strongly absorbing in the near infrared spectral region, i.e., from about 750 nm to about 1000 nm. Furthermore, iron(III) salts are generally substantially insoluble in organic solvents and, therefore, will remain dispersed in the binder and not cause premature image development. Useful metal salts preferably have a melting point between 50° C. and 170° C., most preferably between 70° C. and 120° C. The metal salt is chosen so that the melting point is not so low as to permit reaction at room temperature, nor so high that the reaction will not occur upon exposure to temperatures commonly utilized in thermal print heads.

The catechols useful in the present invention are chosen to be non-reactive with the metal salts at room temperatures, and to be rapidly reactive at elevated temperatures, e.g., above about 50° C. Additionally, the catechols are chosen to be soluble in organic solvents, which also serve as solvents for the binder used. In this invention, these catechols are preferably chosen from the polycatechols and heavily ballasted monocatechols disclosed in U.S. Pat. No. 4,808,565 (Whitcomb et al.), which is incorporated herein by reference.

The catechols can have either electron-donating or electron-withdrawing substituents. These substituents control the color and near infrared absorption properties of the final image. For iron salts, electron-donating substituents are desirable, and include moieties such as alkyl, mono-or dialkyl substituted amino, alkoxy etc. These moieties enable the catechol to be oxidized more readily by the iron, which is essential for obtaining the near infrared absorption properties (at 905 nm in particular) needed for bar-code readers.

Of particular importance to this invention is that the catechol and the binder are soluble in a common solvent so that after coating and drying, the catechol remains in solid solution in the binder. The metal salts are substantially insoluble in both the solvent and the binder and hence remain dispersed in the latter as microparticles thereby preventing premature image development until such time as thermal imaging is desired.

If the catechol is not soluble in the solvent and it is also present in the binder as dispersed microparticles, the metal salt and the catechol will exhibit very poor reactivity, even at elevated temperatures, which is highly undesirable.

Binders suitable for use in this invention include polyacrylate and methacrylate and their copolymers, vinyl resins, styrene resins, cellulose resins, polyester resins, urethanes, alkyl resins, silicones, and epoxy resins. Generally, the resins are miscible with organic solvents and have a melting point above the reaction temperature of the metal salts and catechols. Preferably, the binder is substantially transparent, so as not to interfere with the color provided by the colorant.

Any suitable dye or pigment may be used as the colorant in the formulation, provided it is readily dispersible in an organic solvent and does not absorb strongly in the near infrared region of the spectrum. Organic pigments are preferred because of their stability and also because they do not react with the color-forming components of the medium.

The colorant is added to the dispersion in a quantity sufficient to render it intensely colored. The intensely colored media of the present invention is defined as having a maximum background reflectance value of less than about 70% at any and all wavelengths in the range of from 400 nm to 700 nm. Preferably, the intensely colored media has a maximum background reflectance value of less than about 60% at any and all wavelengths in the range of from 400 nm to 700 nm. The reflectance value is determined using a Hunter Labscan II, spectro colorimeter. White or lightly colored media typically have maximum reflectance values greater than 70% in the visible spectral region. The more intensely colored the medium, the lower the value of the maximum reflectance. Some samples have more than one maximum reflectance due to blending of primary colorants to produce the desired final color.

In this manner many examples of intensely colored thermographic media may be produced by judicious choice of pigments, including blues, greens and violets. Although pink and yellow colored media may be produced, it has been found that these colored media exhibit print contrast, and other optical performance characteristics, most like an unpigmented media and unlike the intensely colored media of the present invention. Unlike the intensely colored media, yellows and pinks are scannable at 633 nm in the visible spectral region.

A coating composition suitable for making an intensely colored, near infrared scannable, thermographic medium can be prepared in the following manner. The metal salt and the colorant are dispersed in a solvent such as acetone, methyl ethyl ketone, ethanol, etc., by ball milling. To this dispersion a polymeric binder and a catechol, both soluble in the chosen solvent, are added and agitated until dissolved. The coating composition may then be coated on a suitable substrate and dried at temperatures below thermal reaction temperatures. Preferably the coating composition comprises from about 100 parts by weight metal salt, from about 20 to 150 parts by weight catechol, from about 30 to 200 parts by weight binder, and from about 2 to 80 parts by weight colorant. Additionally, it is preferred that the catechol, metal salt and colorant be present in the coating composition in such relative quantities as necessary to provide a thermographic medium, that, upon thermal imaging, has an image reflectance ($R_{image}$) and a background reflectance ($R_{bkg}$) which satisfy the equation:

$$\log_{10} R_{image} \leqq 2.6\ (\log_{10} R_{bkg}) - 0.3$$

when measured at a wavelength within the range of from 750 nm to 1000 nm, and especially at 905 nm.

Substrates which may be used are films of transparent, opalescent, or opaque polymers, paper, optionally with white or colored surface coatings, glass, ceramic, etc. The substrate must be stable and undistorted at the thermal reaction temperatures which are preferably between 50° C. and 170° C., and more preferably between 70° C. and 120° C.

Optionally, other materials may be added to the mixture in order to enhance a particular property or characteristic of the thermographic media. For example, it may be desirable to add an inorganic filler such as silica, calcium carbonate or kaolin clay. Additionally, it has been discovered that a small amount of wax, such as polyethylene wax, may be added to provide a non-tacky surface to the resultant media, without any deleterious effect on the performance of the media. Furthermore, it has been discovered that the addition of small amounts of a non-complexing phenolic compound such as bisphenol-A, to the mixture can increase the rate of the reaction between the color forming components, as disclosed in U.S. Pat. No. 4,531,141 (Sagawa), incorporated herein by reference.

The thermographic sheets of the invention are further illustrated by the following nonlimiting examples wherein all parts are by weight unless otherwise specified.

TEST METHOD

The media of Examples 1–4 were imaged by contact with a heated bar having a continuous temperature gradient from 70° C. to 205° C. for 25 milliseconds at 30 psi pressure. The optical properties of each of these imaged media were then measured.

The optical reflectance density of both the background and the image was measured with an optical densitometer such as The MacBeth RD514 or The MacBeth TR924. The background reflectance, image reflectance and print contrast signal was measured at 633 nm and at 905 nm by a MacBeth PCM II print contrast meter.

The color of the background was measured in terms of the Hunter L, $a_L$ and $b_L$ values with a Hunter Labscan II colorimeter using a 2 degree observer and Illuminant C. L is a measure of the "lightness". The more "light" the color the higher the corresponding Hunter L number, for example, black has an L value of 0 and white has an L value of 100.

The background reflectance was measured over wavelengths ranging from 400 nm to 700 nm with a Hunter Labscan II spectro colorimeter. The maximum background reflectance value and the wavelength where the maximum reflectance value occurred (lambda max) were determined and recorded.

EXAMPLE 1

A dispersion was formed by mixing 20.0 grams of iron stearate, 80 grams of acetone and ball milling for 12 hours. A coating composition was then prepared by mixing 5.0 grams of the 20% iron stearate dispersion, 5.0 grams of a solution of 12% celluose acetate in acetone, 0.5 grams of 1.1'-spirobis[-1H-indene]-5,5', 6,6,-tetrol-2,2',3,3,'-tetrahydro-3,3,3',3'-tetramethyl (commercially available from the Alfred Bader division of Aldrich Chemical Company), and 0.05 grams of Microlith® blue 4G-K pigment (commercially available from Ciba-Geigy). This composition was coated on one surface of a paper substrate by means of a knife coater to a wet thickness of 2.0 mils (.005 cm). The coated medium was then allowed to air dry to give a blue thermographic medium.

CONTROL EXAMPLE A

A mixture of 28.0 grams of iron stearate, 3.0 grams of titanium dioxide, 28.0 grams of aluminum silicate, and 14.0 grams of polyethylene wax were added to 210.0 grams of acetone and 41.0 grams of toluene. The resulting mixture was then ball milled to form a dispersion. To the resultant dispersion was then added 9.0 grams of xylene, 110.0 grams of a 12% solution of cellulose acetate in acetone, 4.0 grams of bisphenol-A, and 7.0 grams of 1,1'-spirobis[-1H-indene]-5,5'6,6'-tetrol-2,2',3,3'-tetrahydro-3,3,3',3'-tetramethyl. This composition was coated on one surface of a paper substrate by means of a knife coater to a wet thickness of 2.0 mils (0.005 cm), at an approximate coating weight of about 0.6 grams per square foot. The coated paper substrate was allowed to dry at room temperature and produced a light buff colored media.

EXAMPLES 2-3

Paper thermographic media were prepared according to the procedure described above for Control Example A, with the exception that organic pigments were added to the dispersion in the ball mixer. The organic pigments used in these formulations are shown below:

| Example No. | Organic Pigment Added |
|---|---|
| 2 (blue) | 0.476 grams of Microlith Blue 4G-K, commercially available from Ciba-Geigy |
| 3 (green) | 0.476 grams Microlith Green G-T, commercially available from Ciba-Geigy |

EXAMPLE 4

A black thermographic medium was prepared according to the method described above for Control Example A except that the xylene was omitted from the formulation and the following organic pigments were added to the dispersions in the ball mixer.

| | |
|---|---|
| 2.8 | grams of Microlith Yellow 3R-T commercially available from Ciba-Geigy. |
| 1.9 | grams of Microlith Scarlet R-T commercially available from Ciba-Geigy. |
| 15.4 | grams of Microlith Blue 4G-T commercially available from Ciba-Geigy. |

The thermographic media of Examples 1-4 and Control Examples A and B were tested according to the test method described above and the results are shown in Table 1.

CONTROL EXAMPLE B

Control Example B is a yellow thermographic medium commercially available from Minnesota Mining and Manufacturing Company under the trade designation "Scotchmark" brand thermal labeling stock.

TABLE 1

| | Examples | | | | | |
|---|---|---|---|---|---|---|
| | 1 | Control A | Control B | 2 | 3 | 4 |
| Optical Density | | | | | | |
| Bkg. | .65 | .12 | .13 | .31 | .34 | 1.26 |
| Image | 1.39 | 1.04 | 1.05 | 1.00 | 1.02 | 1.35 |
| 905 nm | | | | | | |
| $Ref_{Bkg}$ | .74 | .81 | .81 | .81 | .81 | .84 |
| $Ref_{Image}$ | .10 | .16 | .13 | .20 | .19 | .18 |
| Print Contrast | .85 | .80 | .82 | .74 | .75 | .79 |
| 633 nm | | | | | | |
| $Ref_{Bkg}$ | | .81 | .77 | .34 | .30 | .03 |
| $Ref_{Image}$ | | .07 | .06 | .06 | .06 | .02 |
| Print Contrast | | .90 | .91 | .81 | .78 | — |
| Hunter Color Values | | | | | | |
| L | 63.38 | 86.50 | 84.5 | 72.87 | 68.72 | 20.93 |
| $a_L$ | −16.86 | 1.38 | −7.74 | −14.91 | −24.96 | −.83 |
| $b_L$ | 6.36 | 10.49 | 35.0 | −9.96 | 6.01 | .18 |
| Lambda max | 500 | 700 | 690 | 500 | 510 | 560 |
| Ref (% at max) | 49.0 | 74.2 | 82.5 | 64.5 | 68.4 | 5.7 |

In Table 1 the examples 2(blue) and 3(green) demonstrate that a thermographic media may be intensely colored and still retain an acceptable print contrast, as defined by UPC standards, when scanned at 905 nm in the near infrared. Example 4 demonstrates that the thermographic media of the present invention may be so intensely colored that the image may not be visually detected, and still retain acceptable print contrast for scanning in the near infrared spectral region. As a comparison, Control Example A, a media containing no added colorant, and Control Example B, a lightly yellow colored thermographic media available from 3M, are shown. Control Examples A and B are scannable at 633 nm in the visible region, and have maximum reflectance values greater than 70% within the visible region which is indicative of a lightly colored medium.

EXAMPLES 5-7

A stock dispersion was prepared by adding 25.0 grams of Iron(III) di-2-ethylhexyl phosphate to 75.0 grams of acetone and ball milling for 24 hours. To 80.0 grams of the resulting dispersion was added 66.0 grams of a 15% solution of vinyl acetate in acetone and 1.2 grams of di-2-ethylhexyl phosphoric acid. To 12.5 grams of the resulting mixture was added 0.5 grams of 1,1'-spirobis-[1H-indene]-5,5',6,6'-tetrol-2,2',3,3,'-tetrahydro-3,3,3',3'-tetramethyl. To this stock dispersion was added the organic pigments described below and the resulting composition was coated on one surface of a titanium dioxide filled polyester film substrate by means of a knife coater to a wet thickness of 2.5 mils(0.006 cm). The coated media were allowed to dry at room temperature and to produce intensely colored thermal recording media.

| Examples 5-7 | |
|---|---|
| Example No. | Organic Pigment Added |
| 5 (blue) | 0.15 grams of Microlith Blue 4G-K, commercially available from Ciba-Geigy |
| 6 (violet) | 0.24 grams of ChromaChem Carbazole Violet, commercially available from Nuodex |
| 7 (green) | 0.2 grams of ChromaChem Phthalo Green, commercially available from Nuodex |

The thermographic media of Examples 5-7 were imaged as described above for Example 1-4, and the optical properties were measured and recorded below in Table 2.

TABLE 2

| | Examples | | |
|---|---|---|---|
| | 5 | 6 | 7 |
| Optical Density | | | |
| Bkg. | .46 | .71 | .40 |
| Image | .96 | 1.19 | .89 |
| 905 nm | | | |
| $Ref_{Bkgd}$ | .71 | .68 | .70 |
| $Ref_{Image}$ | .17 | .20 | .19 |
| Print Contrast | .75 | .70 | .72 |
| 633 nm | | | |
| $Ref_{Bkgd}$ | .25 | .25 | .12 |
| $Ref_{Image}$ | .03 | .03 | .01 |
| Print Contrast | .85 | .84 | .89 |
| L | 61.52 | 45.70 | 66.99 |
| $a_L$ | −5.71 | 29.20 | −38.10 |
| $b_L$ | −24.66 | −48.74 | 3.79 |
| Lambda max | 480 | 440,700 | 510 |
| % Ref (at max) | 52 | 45.3,46.3 | 57.4 |

In Table 2 the results of the tests on the media of Examples 5(blue), 6(violet) and 7(green) demonstrate that intensely colored thermographic media may be prepared using iron phosphates and retain the desired print contrast, as defined by UPC standards, when scanned in the near infrared at 905 nm. Examples 5–7 do not meet the desired print contrast requirements when scanned at 633 nm.

EXAMPLES 8–10

A stock dispersion was prepared as follows: To 37.9 grams of acetone was added 11.1 grams of methyl ethyl ketone, 5.2 grams of iron stearate, 0.6 grams of titanium dioxide, 2.8 grams of micronized polyethylene wax, 2.8 grams of aluminum silicate and 36.3 grams of a 12% solution of cellulose acetate in acetone. To 25.0 grams of the above dispersion was added 0.75 grams of 3,5-di-t-butyl catechol. To this stock dispersion was added the organic pigments described below and the resulting dispersion was coated on one surface of a paper substrate to a wet thickness of 2.0 mils (0.005 cm) with the aid of a knife coater and allowed to air dry to form intensely colored thermographic media.

| Examples 8–10 | |
|---|---|
| Example No. | Organic Pigment Added |
| 8 (blue) | 0.3 grams of Microlith Blue 4G-K. commercially available from Ciba-Geigy |
| 9 (violet) | 0.5 grams of ChromaChem 844 Carbazole Violet, commercially available from Nuodex. |
| 10 (green) | 0.5 grams of ChromaChem 844 Phthalo Green, commercially available from Nuodex. |

The thermographic media of Examples 8–10 were imaged as described above for Example 1–4, and the optical properties of the imaged media were measured and recorded. The optical properties for these media are shown below in Table 3.

TABLE 3

| | Examples | | |
|---|---|---|---|
| | 8 | 9 | 10 |
| Optical Density | | | |
| Bkg. | .61 | .67 | .49 |
| Image | 1.21 | 1.18 | 1.15 |
| 905 nm | | | |
| $Ref_{Bkg}$ | .65 | .78 | .69 |
| $Ref_{Image}$ | .09 | .13 | .11 |
| Print Contrast | .85 | .83 | .83 |
| 633 nm | | | |
| $Ref_{Bkg}$ | .14 | .25 | .08 |
| $Ref_{Image}$ | .02 | .05 | .02 |
| Print Contrast | .79 | .76 | .60 |
| Hunter Color Values | | | |
| L | 50.8 | 45.0 | 57.4 |
| $a_L$ | −11.2 | 17.3 | −34.7 |
| $b_L$ | −18.8 | −26.5 | 5.3 |
| Lambda max | 490 | 470,700 | 510 |
| % Ref (at max) | 41.4 | 33.4,43.8 | 43.6 |

The thermographic media of Examples 8(blue), 9(violet) and 10(green) were prepared using pigments in quantities in excess of those shown in examples 1–7 to produce thermographic media even more intensely colored. It can be seen from the data shown in Table 3 that the media of examples 8–10 do meet the print contrast requirements set by UPC standards when scanning at 905 nm in the near infrared, yet are not scannable at 633 nm in the visible due to insufficient print contrast.

What is claimed is:

1. An intensely colored thermographic medium comprising a substrate having on at least one surface thereof a coating comprising:

(a) a substantially transparent film-forming binder, (b) an organic solvent soluble catechol in solid solution in said binder, (c) substantially insoluble microparticles of a metal salt dispersed throughout said binder, and (d) at least one colorant dispersed throughout said binder in an amount sufficient to provide said thermographic medium with a maximum background reflectance of less than about 70% at any and all wavelengths within the range of from 400 nm to 700 nm; wherein said metal salt and said catechol are unreactive at room temperatures but react to form a near infrared absorbing complex upon the application of heat.

2. The intensely colored thermographic medium of claim 1 wherein, after imaging with heat, said imaged thermographic medium has an image reflectance ($R_{image}$) and a background reflectance ($R_{bkg}$), measured at a wavelength within the range of from 750 nm to 1000 nm, satisfying the equation:

$$\log_{10} R_{image} \leqq 2.6 (\log_{10} R_{bkg}) - 0.3$$

3. The intensely colored thermographic medium of claim 2 wherein said, metal salt is a salt of an aliphatic organic acid having an alkyl portion containing from 8 to 24 carbon atoms.

4. The intensely colored thermographic medium of claim 2 wherein said metal salt is a salt of an acid selected from the group consisting of carboxylic acids and phosphoric acids having alkyl portions containing from 8 to 24 carbon atoms.

5. The intensely colored thermographic medium of claim 4 wherein said alkyl portions of said acid contains from 14 to 20 carbon atoms.

6. The intensely colored thermographic medium of claim 5 wherein said metal salt has a melting point between about 50° C. and 170° C.

7. The intensely colored thermographic medium of claim 6 wherein said metal salt has a melting point between 70° C. and 120° C.

8. The intensely colored thermographic medium of claim 7 wherein said metal salt is a salt of a metal selected from the group consisting of iron, vanadium, nickel and copper.

9. The intensely colored thermographic medium of claim 8 wherein said metal salt is a salt of iron(III).

10. The intensely colored thermographic medium of claim 9 wherein said catechol has at least one catechol moiety bearing electron donating substituents which provide an overall electron donating effect to said catechol moiety.

11. The intensely colored thermographic medium of claim 10 wherein said catechol is 1,1'-spirobis [-1H-indene]-5,5',6,6-tetrol-2,2',3,3'-tetrahydro-3,3,3',3'-tetramethyl.

12. The intensely colored thermographic medium of claim 9 wherein said colorant is an organic pigment.

13. The intensely colored thermographic medium of claim 12 wherein said coating comprises about 100 parts by weight iron salt, from about 20 to 150 parts by weight catechol, from about 30 to 200 parts by weight binder, and from about 2 to 80 parts by weight organic pigment.

14. An intensely colored thermographic medium comprising a substrate having on at least one surface thereof a coating comprising:

(a) a transparent film-forming binder;

(b) 1,1'-spirobis[-1H-indene]-5,5',6,6'-tetrol- 2,2',3,3'-tetrahydro-3,3,3',3'-tetramethyl;

(c) microparticles of an iron(III) salt of an aliphatic organic acid, having an alkyl portion containing from 14 to 20 carbon atoms; and (d) inorganic pigment in an amount sufficient to provide said thermographic medium with a maximum background reflectance of less than 70% at any and all wavelengths within the range of from 400 nm to 700 nm; wherein, after imaging with heat, said imaged thermographic medium has an image reflectance ($R_{image}$) and a background reflectance ($R_{bkg}$), measured at a wavelength within the range of from 750 nm to 1000 nm, satisfying the equation:

$$\log_{10} R_{image} \leqq 2.6 (\log_{10} R_{bkg}) - 0.3$$

15. The intensely colored thermographic medium of claim 14 wherein said image reflectance ($R_{image}$) and said background reflectance ($R_{bkg}$), measured at 905 nm, satisfy the equation:

$$\log_{10} R_{image} \leqq 2.6 (\log_{10} R_{bkg}) - 0.3$$

16. The intensely colored thermographic medium of claim 15 wherein said coating further comprises an inorganic filler selected from the group consisting of silica, calcium carbonate and kaolin clay.

17. The intensely colored thermographic medium of claim 15 wherein said coating further comprises a sufficient amount of wax to provide a non-tacky surface to the thermographic medium.

18. The intensely colored thermographic medium of claim 15 wherein said coating further comprises an amount of a non-complexing phenolic compound sufficient to increase the rate of reaction between said iron(III) salt and said 1,1'-spirobis[-1H-indene]-5,5',6,6'-tetrol-2,2',3,3'-tetrahydro-3,3,3',3'-tetramethyl.

19. The intensely colored thermographic medium of claim 18 wherein said non-complexing phenolic compound is bisphenol-A.

20. The intensely colored thermographic medium of claim 15 wherein said inorganic pigment is present in an amount sufficient to provide said thermographic medium with a maximum background reflectance of less than 60% at any and all wavelengths within the range of from 400 nm to 700 nm.

* * * * *